US005701614A

United States Patent [19]

Appleford et al.

[11] Patent Number: 5,701,614

[45] Date of Patent: Dec. 30, 1997

[54] INVALID BATH

[75] Inventors: David E. Appleford; Brian W. Lane, both of Essex; Alan D. Webb, Kent, all of England

[73] Assignee: Alpha Thames Engineering Limited, England

[21] Appl. No.: 586,751

[22] PCT Filed: Jul. 21, 1994

[86] PCT No.: PCT/GB94/01578

§ 371 Date: Oct. 15, 1996

§ 102(e) Date: Oct. 15, 1996

[87] PCT Pub. No.: WO95/02982

PCT Pub. Date: Feb. 2, 1995

[30] Foreign Application Priority Data

Jul. 21, 1993 [GB] United Kingdom ..... 9315094

[51] Int. Cl.[6] ..... A47K 3/02

[52] U.S. Cl. ..... 4/555

[58] Field of Search ..... 4/555, 556

[56] References Cited

U.S. PATENT DOCUMENTS 4,993,087 2/1991 Roguebrune ..... 4/555

5,184,358 2/1993 Gruidel et al. ..... 4/555

*Primary Examiner*—Charles E. Phillips

*Attorney, Agent, or Firm*—Biebel & French

[57] ABSTRACT

A bath (1) for use by an elderly or disabled person. The bath (1) includes a side opening (3) which extends over the full width and height of the bath (1) and is surrounded by and outwardly and downwardly extending skirt (8). A door (4) with a channel (9) on its inner surface is upwardly translatable in its own plane to bring the door (4) over the opening (3) and force the skirt (8) into sealing engagement with a seal (11, 40) in the channel (9) which may be a foamed rubber seal or a part fluid=filled flexible tube up which the fluid is squeezed to effect sealing in upper portions of the tube as closing is completed.

10 Claims, 6 Drawing Sheets

INVALID BATH

This invention relates to a bath incorporating a sealing device, and more particularly to a type of bath designed specially for use by elderly or disabled persons.

Such baths are known in which part of one side of the bath is formed by a movable door forming an opening through which the user can enter the bath without having to climb over the top of the bath. The door is then closed and the bath can be filled with water. When the user wishes to get out of the bath, the bath is first emptied of water and the door can then be opened again.

In order to prevent water leakage from the bath, it is necessary to have a water-tight seal between the door and the opening. Baths of this type generally have one of two types of door. The first type of door is rotated towards and away from the opening and accordingly sweeps a large area of the room in which the bath is situated as the door is rotated. The second type of door is slid over the opening and then clamped against the bath. Both of these types of door require separate moving and clamping arrangements, which add to manufacturing costs and overall complexity of the bath. It is therefore an object of the present invention to provide a bath suitable for elderly or disabled persons which overcomes the above mentioned disadvantages.

U.S. Pat. No. 3,955,219 (on which the pre-characterising part of claim 1 is based) discloses an invalid bath in which a door is vertically slidable from a lowered open position to a raised closed position. Parallel side edges of the door sliding channels lined with gasket material as the door is raised and lowered. Friction between the door edges and gasket material will accordingly occur as the door is raised and lowered.

Thus according to the invention there is provided a bath particularly for use by an elderly or disabled person, the bath having a body with a side shaped so as to form an opening, a movable door arranged to close the opening and a sealing arrangement for sealing between the opening and the door, which comprises confronting surfaces between which sealing means is interposed and each of which is connected to one of the body and the door and are configured to be urged sealingly together by sliding of the door into the closed position, wherein substantially the entire door is situated below a water accommodating region of the body when fully opened and translation of the door substantially within its own plane effects closure of the opening and sealing between the confronting surfaces characterised in that the confronting surfaces are constituted by a first surface connected to the bath around the opening and a second surface connected to an inwardly facing surface of the door.

By using a sliding action substantially within a plane containing the door to both close the door and seal the door over the opening considerable simplification of the mechanism required to move the door between open and closed positions is possible.

By connecting the first surface to the bath around the opening and connecting the second surface to an inwardly facing surface of the door a particularly effective seal can be achieved between the confronting surfaces. Preferably the first surface is constituted by a skirt for example connected to the bath around the opening, and the second surface is constituted by a channel, for example connected to the inwardly facing surface of the door. The skirt may alternatively be connected to the door and the channel located around the opening.

So as to facilitate insertion of the skirt into the channel the skirt preferably extends substantially parallel to a plane along or in which the door slides.

Preferably sealing means which is conveniently located in and connected to the channel is interposed between the confronting surfaces to enhance the seal therebetween. Suitable materials which allow adequate tolerance of the position of the door relative to the aperture without adversely affecting the seal therebetween include foamed materials such as closed cell foamed rubber.

So as to still further accommodate such tolerance the sealing means preferably comprises a hollow resilient sealing element arranged such that a lower portion of said element is located below a higher portion thereof, the element containing a liquid which is situated in its lower portion when the door is open, and the sealing means being arranged such that an amount of liquid is forced from the lower portion into the upper portion of the sealing element when the confronting surfaces are urged sealingly together, thereby producing a seal therebetween along both the lower and upper portions of the sealing element. With such an arrangement an effective seal can be provided even if sides of the aperture are substantially parallel, in which situation no wedging effect would be possible to enhance the seal along the sides.

Preferably however, the confronting surfaces are upwardly concave in a plane containing the opening so that such a wedging effect is possible. Conveniently the opening has a substantially flat lower portion and diverging side portions.

In order to facilitate movement of a user in and out of the bath, preferably the entire door is situated below a bottom of the bath when fully open. In other words the body of the bath will be supported above floor level by a frame or other suitable means.

More preferably the opening extends substantially the entire width and height of a water accommodating region of the body as well so that a user does not need to clamber round side regions of the body of the bath to get in or out of it.

In order to reduce the chance of a door moving operation harming a person using the bath the door preferably slides down into an enclosed region of the bath and an obstruction sensor may be provided to sense when anything comes close to an upper region of the door so that in such circumstances door movement can be automatically arrested.

The invention will now be described by way of example with reference to the accompanying drawings, in which.

Figure 1:
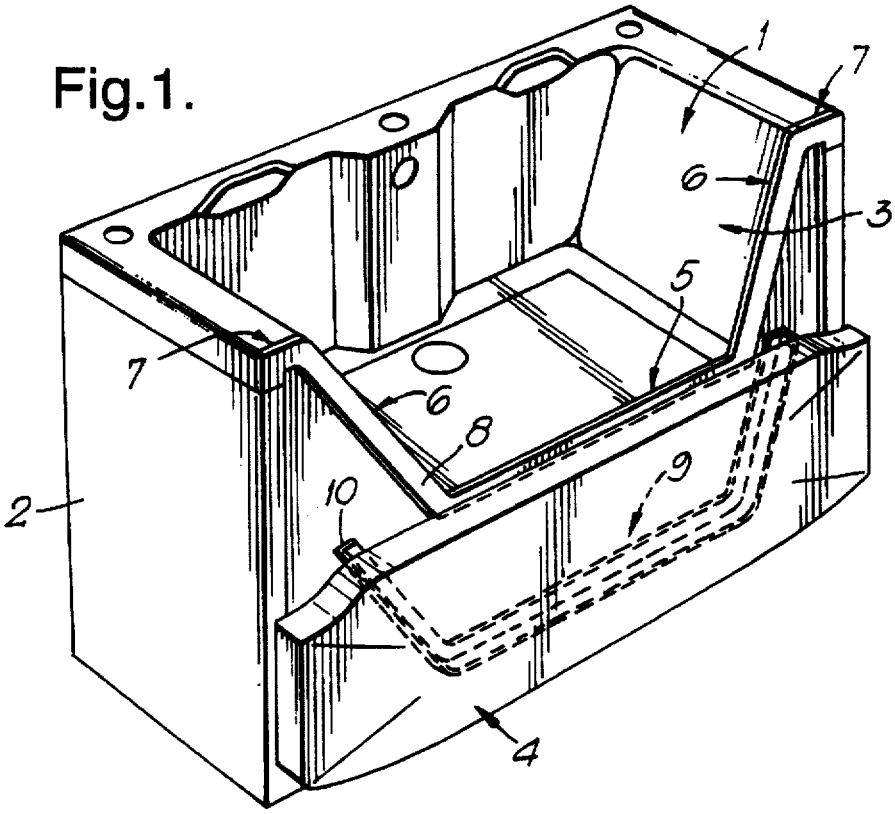
FIGS. 1 and 2 show perspective schematic views of a bath in accordance with one embodiment of the invention with its door open and closed respectively.

Referring firstly to FIGS. 1 to 4, the bath 1 is supported on a support frame 2 above the floor level and has, in one long side thereof, an opening 3 closed by a door 4.

The opening 3 is formed by shaping of the upper edge of the bath so as to provide a lower generally horizontal edge 5 of the opening and side edges 6 which slope upwardly and outwardly generally towards upper corners 7 of the side of the bath. A downwardly-projecting peripheral skirt 8 is provided around the periphery of the opening 3.

Figure 2:
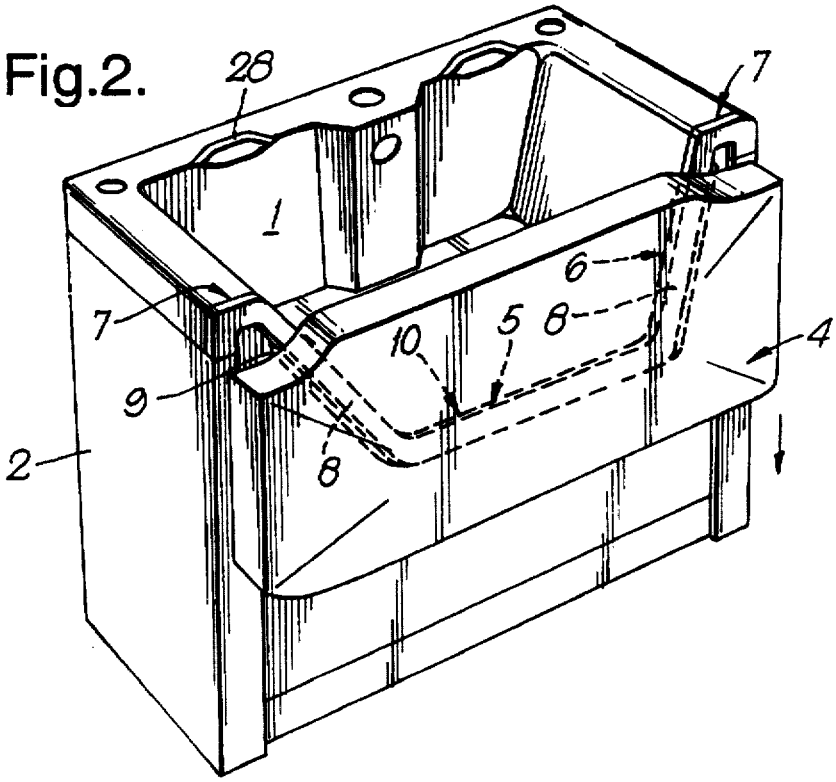
Figure 3:
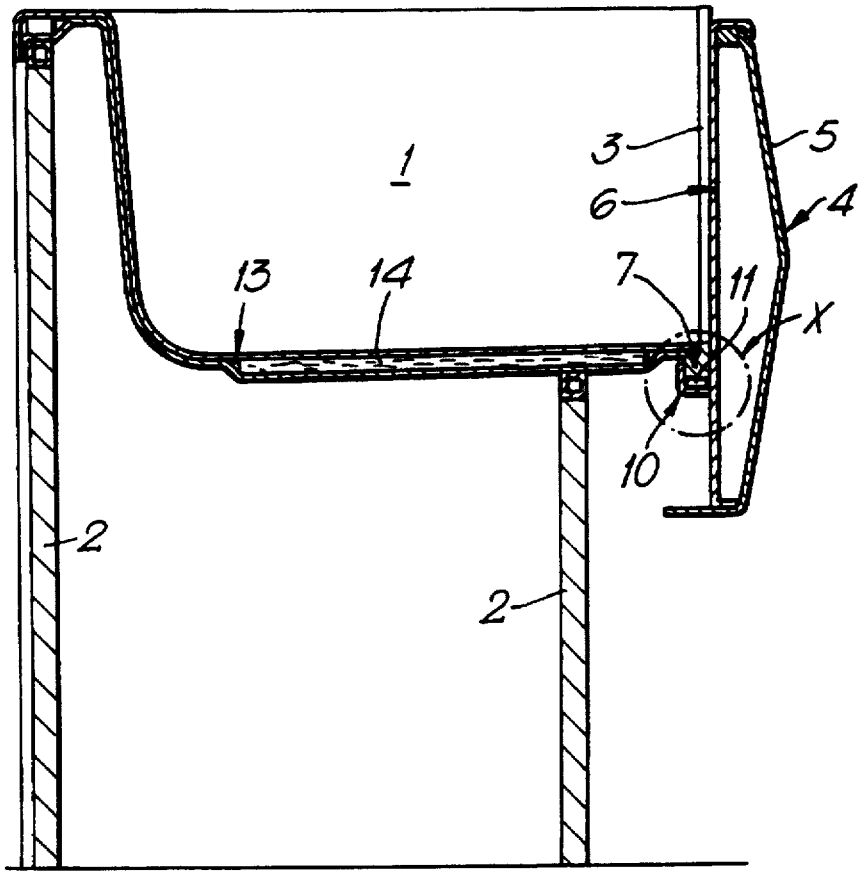
FIG. 3 is a schematic transverse sectional view of the bath.
Figure 4:
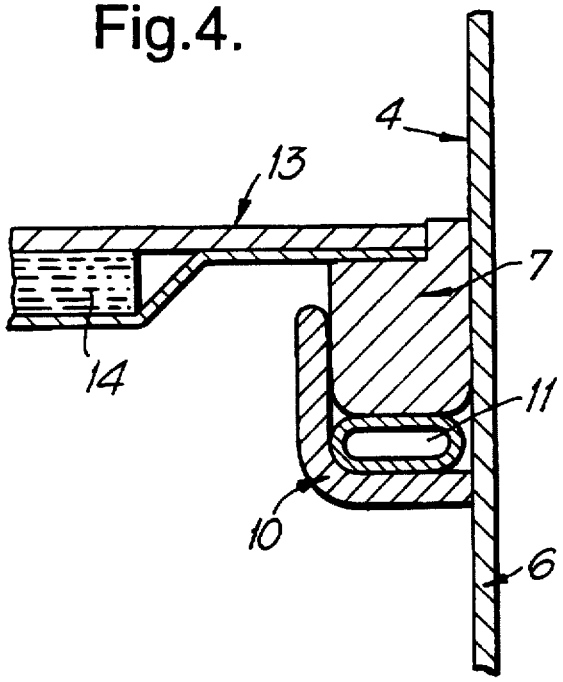
FIG. 4 is an enlargement of the details shown in the circle marked X in FIG. 3.

An elongate channel 9 is formed on the rear side of the door 4 adjacent the bath side by an elongate part 10 having an L-shaped cross-section fixed to the door rear side, the part 10 forming the bottom and one side of the channel and the door rear side forming the other side of the channel. The channel part 10 is shaped so as to conform to the shape of the lower edge of the peripheral skirt 8 so that the skirt engages within the channel 9 when the door 4 is closed as shown in FIG. 2.

A sealing element 11 in the form of a hollow resilient tube, preferably made of rubber, is located in the channel 9 so that it conforms to the shape of the channel, thereby providing a lower portion of the sealing element along the horizontal middle part of the channel and two upper portions of the sealing element along the sloping ends of the channel. A quantity of liquid (not shown) is contained within the lower portion of the sealing element 11 when the door is in its open position shown in FIG. 1. The sealing element 11 may alternatively be of a resilient foamed closed cell rubber-like material (e.g. neoprene).

The lower horizontal edge 5 of the opening 3 is only a short distance above the inside bottom 13 of the bath, and the bath bottom is reinforced by a suitable reinforcement panel 14.

Figure 5:
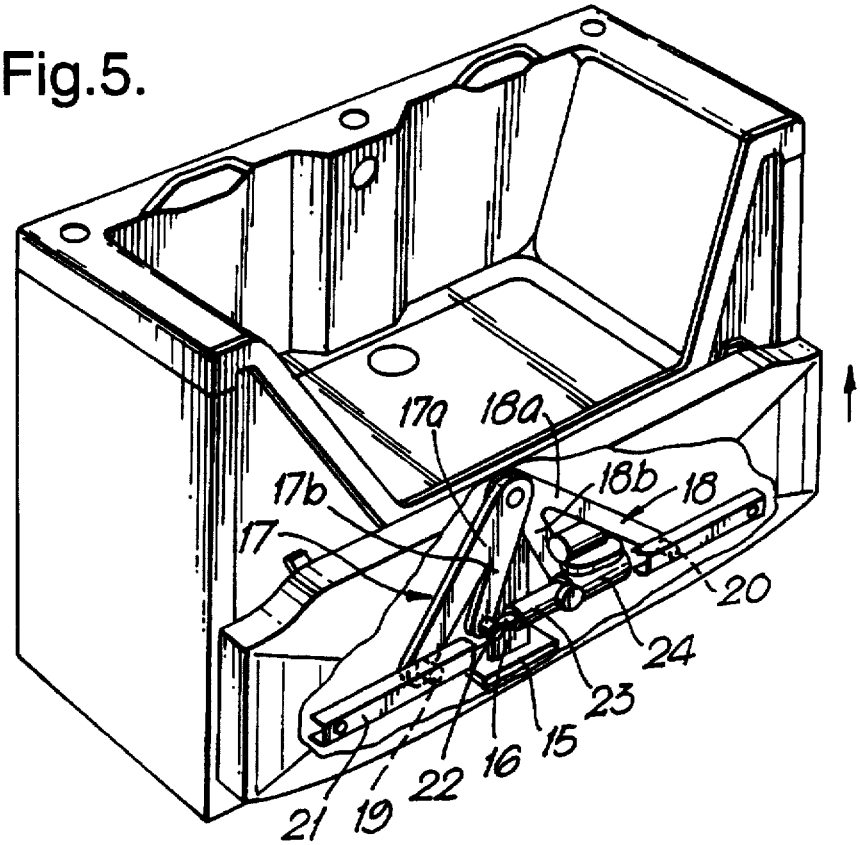
FIGS. 5 and 6 show the same views as FIGS. 1 and 2 respectively including a mechanism for lowering and raising the door.
Figure 6:
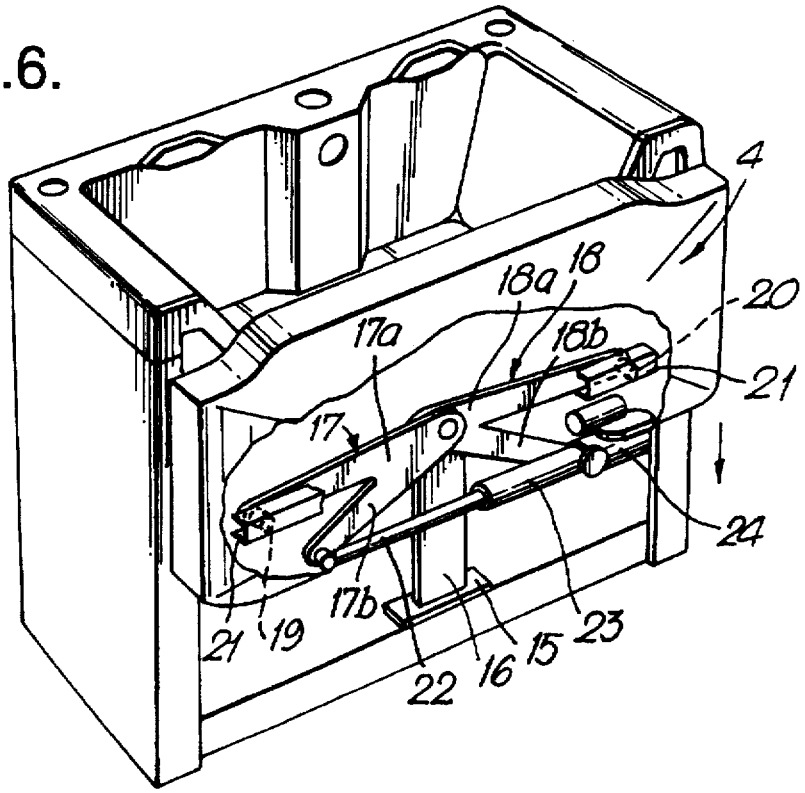

FIGS. 5 and 6 show a mechanism for slidably lowering and raising the door relative to the side of the bath. A platform 15, which is fixed to the floor, supports a post 16, to the top of which are pivotally hinged two bell-crank levers 17, 18, each lever 17, 18 having two arms 17*a*, 17*b*, 18*a*, 18*b*, respectively.

The ends of the outer arms 17*a*, 18*a* have smooth cylindrical rollers 19, 20 fixed to, and projecting at right angles from, the arms 17*a*, 18*a* and resting in a horizontal guide rail 21 of U-shaped cross-section. The guide rail 21 is fixed to the rear side of the door 4 and is used to support the channel part 10.

The inner arms 17*b*, 18*b* of the bell-crank levers 17, 18 are arranged on the bath side of their respective outer arms 17*a*, 18*a*. The ends of the inner arms 17*b*, 18*b* are hinged to a ram 22 and a body 23 of an electro-mechanical actuator 24 which is arranged to float on these arms 17*b*, 18*b*.

In use of the bath, whilst the door is in its open position, an elderly or disabled person can enter the bath through the opening 3. A control (not shown) for actuating the mechanism to close the door is then operated. This causes the actuator 24 to push the ram 22 out of the body 23, thus pushing the ends of the inner arms 17*b*, 18*b* of the bell-crank levers 17, 18 outwardly relative to each other. The outer arms 17*a*, 18*a* are also moved outwardly so that the rollers 19, 20 move upwardly in an arcuate path. As the rollers are constrained to move within the guide rail 21, the upward movement of the levers 17, 18 raises the door 4 to its closed position.

As the door 4 reaches its closed position, the peripheral skirt 8 engages in the channel 9, and the abutting lower edge of the skirt 8 and the bottom of the channel constrict the sealing element 11 so that liquid in the lower portion of the element is forced out into its upper portions. Thus in the closed position of the door, the liquid is distributed along the length of the sealing element 11 thereby providing a water-tight seal along the entire periphery of the opening. When the door is opened again by the raising and lowering mechanism, the channel 9 is disengaged from the peripheral skirt 8 so that the pressure on the sealing element 11 is removed and the liquid therein again collects by gravity in the horizontal lower portion of the element.

An alternative mechanism for moving the door 4 will now be described with reference to FIGS. 8–11 in which parts similar to those discussed above are identified with like numerals and will not be described in detail.

The support frame 2 includes a vertical central post 16 to the upper end of which two lever arms 32, 33 are pivoted by a lever arm pivot pin 35. Lower ends of the lever arms are provided with rollers 19, 20 each of which engages in a roller slot 39 in a guide rail 21 connected to the inner surface of the door 4 adjacent its lower edge. A ram 22 of an actuator 24 is pivotably connected to one lever arm 33 adjacent its roller 20, and the body 23 of the actuator 24 is pivotably connected by means of an actuator clamp 37 to the lever arm 32 adjacent the other roller 19.

Figure 9:
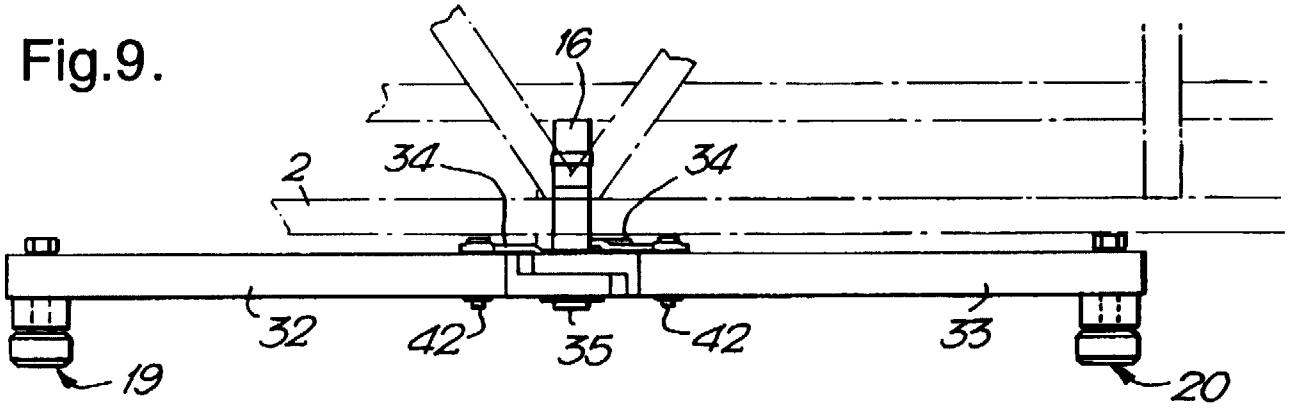
FIG. 9 is a view in the direction of arrow A in FIG. 8 of the mechanism.

Lower ends of two stabiliser struts 34 are interconnected to a lower strut pivot pin 36 which is vertically slidable in a slot 38 in a lower region of the post 16. Upper ends of the stabiliser struts 34 are respectively connected to the two lever arms 32, 33. A limit switch 44 is mounted on a bracket on the lowermost support frame member and serves to provide a signal when the roller 20 and hence the door 4 has reached its lowermost limit. FIG. 9 shows a top view, from the direction of arrow A in FIG. 8, of the door raising mechanism.

Figure 11:
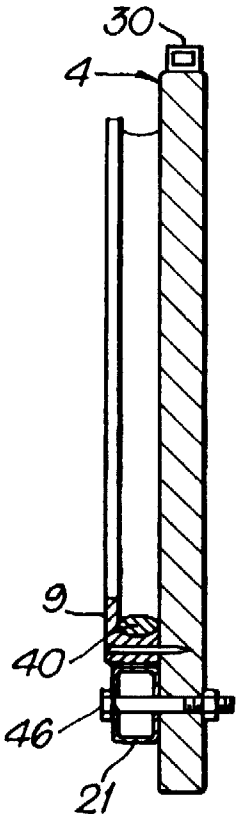
FIG. 11 is a cross-section on the line B—B of the door shown in FIG. 10.
Figure 8:
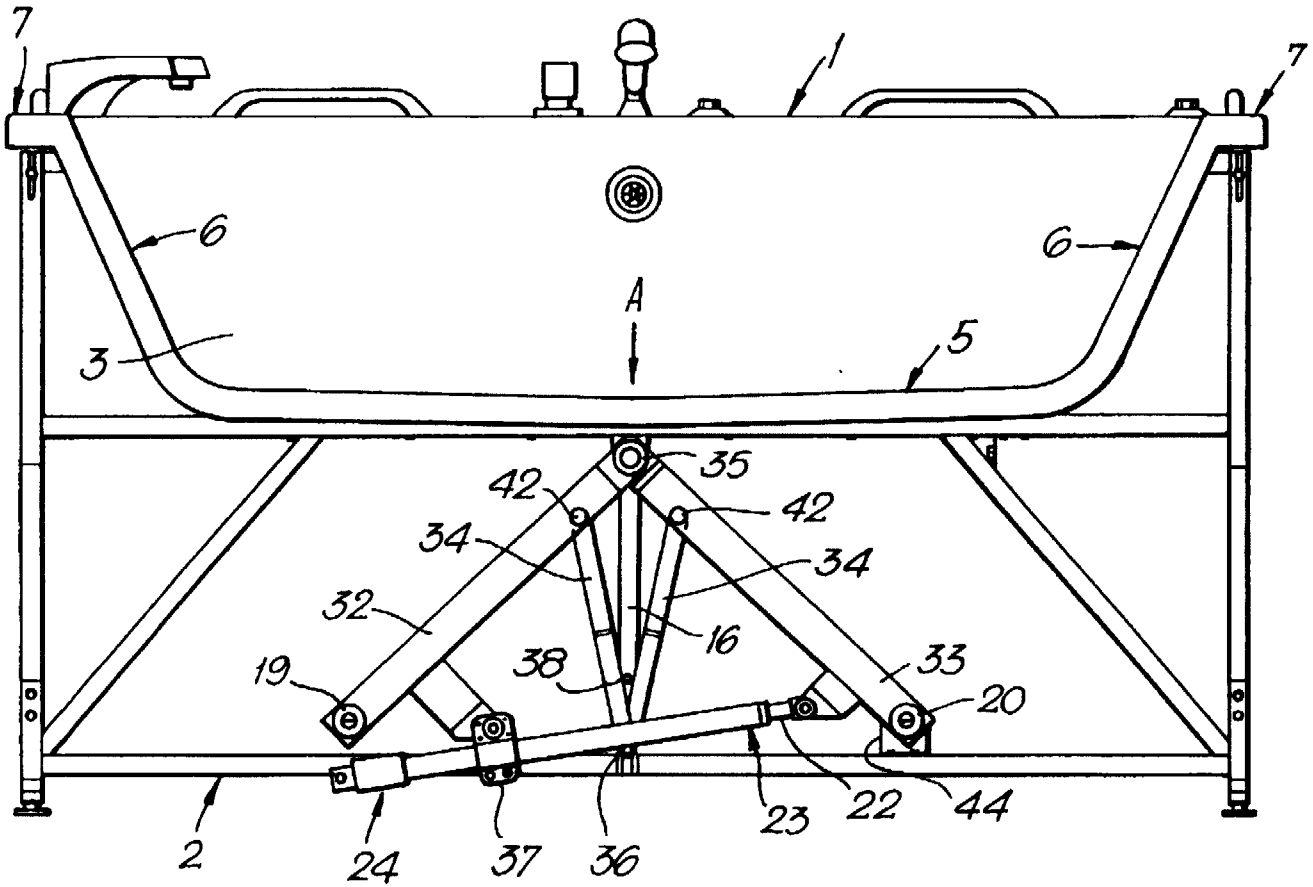
FIG. 8 shows a front elevation of a bath with an alternative door raising mechanism with the door and front cladding panels omitted for clarity.
Figure 10:
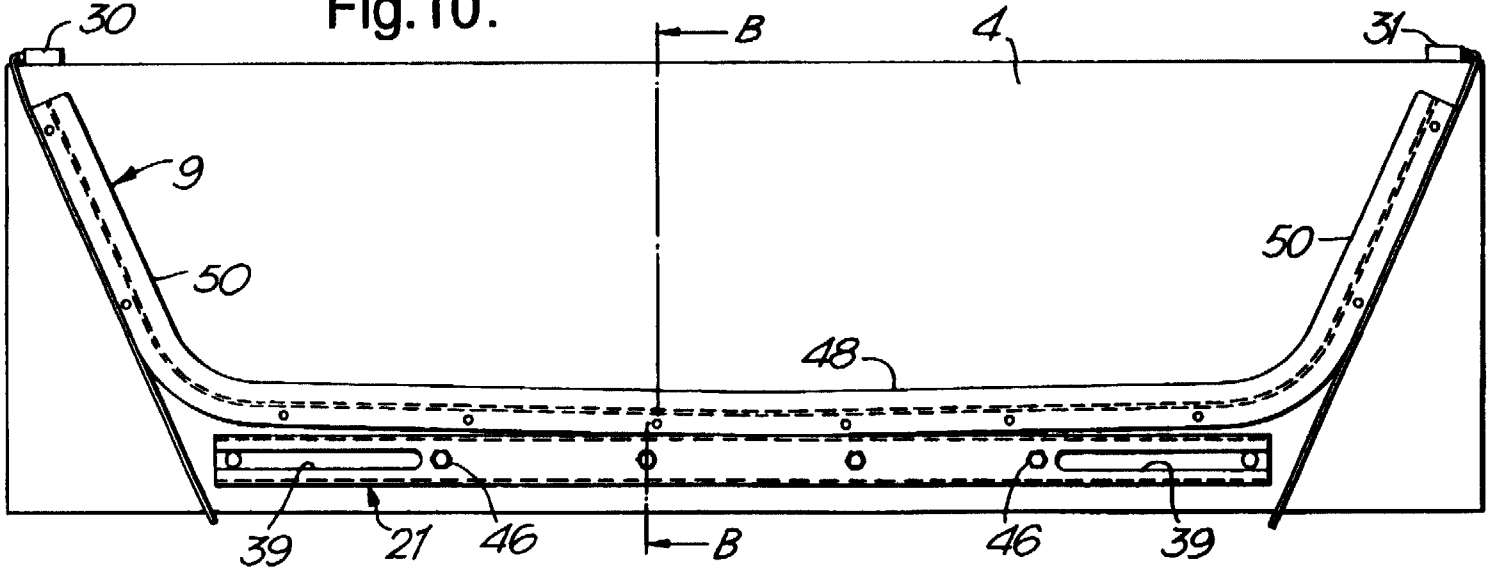
FIG. 10 is an inside view of a door suitable for use with either of the door opening mechanisms.

FIG. 11 shows a vertical cross-section on the line B—B of the door shown in FIG. 10. Connected to an inner face of the door 4 is an elongate channel 9 which has a generally horizontal section 48 and upwardly diverging sections 50. A closed cell neoprene rubber sealing element 40 extends along the entire length of the channel 9 and is sealingly contacted by the peripheral skirt 8 around the bath opening 3 when the door is raised so as to close the opening 3. A guide rail 21 extends along the inner side of the door 4 immediately below the channel 9 and is attached to the door 4 by guide rail bolts 46. Each end of the guide rail is provided with a slot 39 in which a roller of the mechanism described above is engaged.

Extension of the actuator 24 will cause the lever arms 32, 33 to pivot about the lever arm pivot pin 35 and thus raise the rollers 19, 20. As this occurs the lower strut pivot pin 36 is constrained to travel up the slots 38 in the vertical post 16. This prevents any skewing of the door which could lead to jamming. Upward movement of the door is arrested when the peripheral skirt 8 seals against the sealing element 40 which extends the entire length of the channel 9. Thus, the use of a single actuator arranged to slide the door up and down in a single plane opens and closes the opening and also effectively seals the door against the opening.

The invention thus provides a simple and effective water-tight seal between the opening in the bath and the movable door. In addition, the shape of the opening with outwardly sloping sides provides a large opening extending along substantially the entire side of the bath, thereby facilitating access into and out of the bath by an elderly or disabled person.

Figure 7:
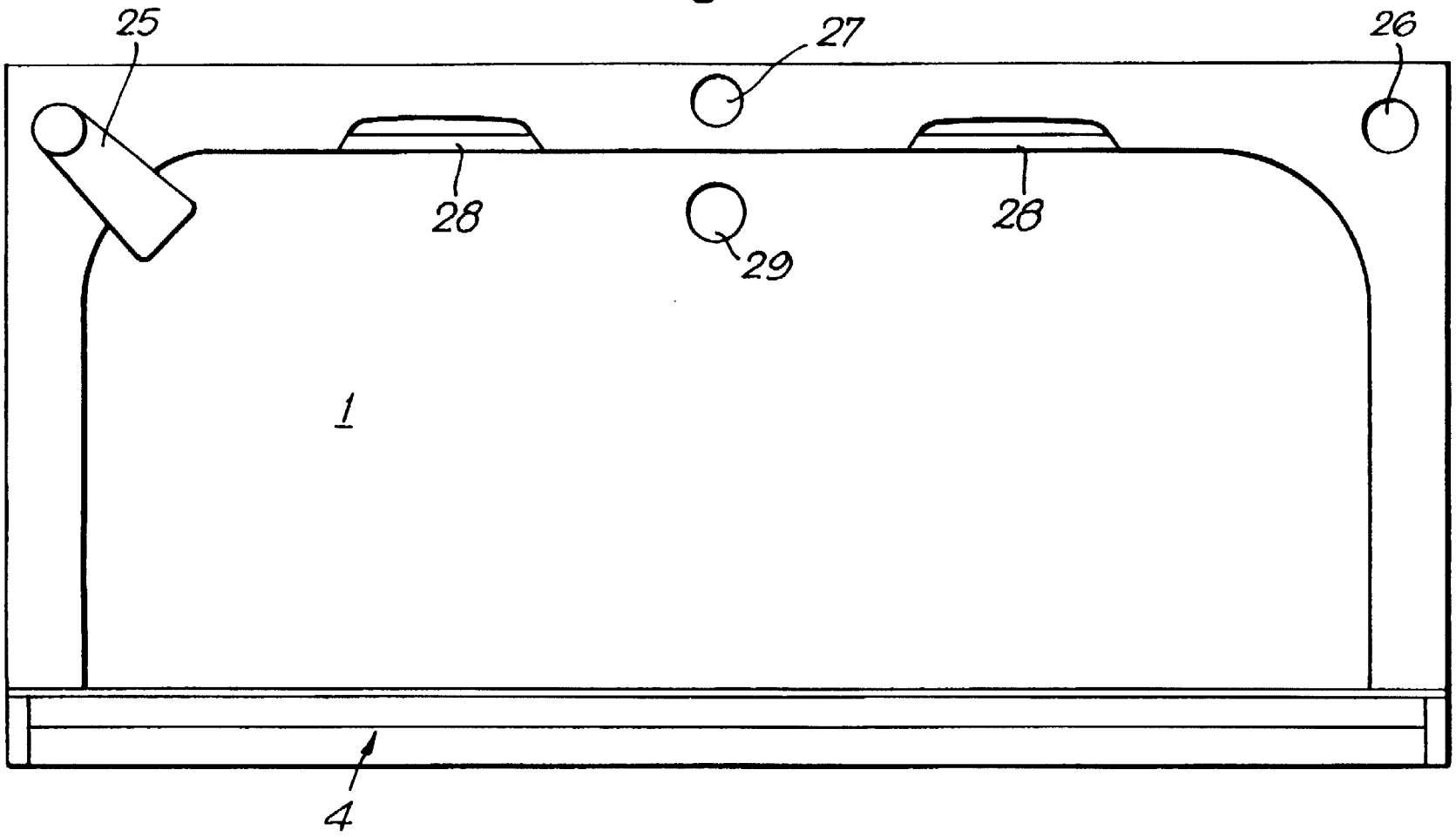
FIG. 7 shows a schematic plan view of the bath.

Various fitments may be added to the bath, some examples of which are shown in FIG. 7. These include a bath filler 25 and a fill/empty control 6 in the rear corners of the upper edge of the bath, a hand shower 27 in the middle of the rear longitudinal upper edge, and hand-grips 28 provided in the longitudinal upper edge. A waste outlet 29 is provided in the bottom of the bath near the hand shower 27 which may be pump assisted to speed up bath emptying. As shown in FIG. 10 the bath door may be provided with a light emitter 30 and a light sensor 31 which are arranged at the top of the door and connected so as to arrest movement of the door in the event of a person resting on the top of the door whether accidentally or intentionally. The temperature of the water entering the bath and the level to which the bath is filled may also both be automatically controlled.

Whilst a particular embodiment of the invention has been described, it will be envisaged that modifications can be made without departing from the scope of the invention. For example, the bath opening may be an alternative shape, or an alternative mechanism other than those shown in FIGS. 5 and 8 may be used to open and close the door. Additionally, although the sealing device in the described embodiment has been utilised in a bath, it may be used in any other suitable application in which an effective seal is required between any two abutting members.

We claim:

1. A bath particularly for use by an elderly or disabled person, the bath having a body with a side shaped so as to form an opening, a movable door arranged to close the opening and a sealing arrangement for sealing between the opening and the door, which comprises confronting surfaces between which sealing means is interposed and each of which is connected to one of the body and the door and are configured to be urged sealingly together by sliding of the door into the closed position, wherein substantially the entire door is situated below a water accommodating region of the body when fully opened and translation of the door substantially within its own plane effects closure of the opening and sealing between the confronting surfaces wherein the confronting surfaces are constituted by a first surface connected to the bath around the opening and a second surface connected to an inwardly facing surface of the door, and the confronting surfaces comprise a channel and a skirt.

2. The bath as claimed in claim 1 wherein the opening extends substantially the entire width and height of a water accommodating region of the body.

3. The bath as claimed in claim 1, wherein the skirt extends substantially parallel to a plane along which the door slides.

4. The bath as claimed in claim 1, wherein the sealing means is connected to the channel.

5. The bath as claimed in claim 1, wherein the sealing means comprises resilient foamed material.

6. A bath particularly for use by an elderly or disabled person, the bath having a body with a side shaped so as to form an opening, a movable door arranged to close the opening and a sealing arrangement for sealing between the opening and the door, which comprises confronting surfaces between which sealing means is interposed and each of which is connected to one of the body and the door and are configured to be urged sealingly together by sliding of the door into the closed position, wherein substantially the entire door is situated below a water accommodating region of the body when fully opened and translation of the door substantially within its own plane effects closure of the opening and sealing between the confronting surfaces wherein the confronting surfaces are constituted by a first surface connected to the bath around the opening and a second surface connected to an inwardly facing surface of the door and wherein the sealing means comprises a hollow resilient sealing element arranged such that a lower portion of said element is located below a higher portion thereof, the element containing a liquid which is situated in its lower portion when the door is open, and the sealing means being arranged such that an amount of the liquid is forced from the lower portion into the upper portion of the sealing element when the confronting surfaces are urged sealingly together, thereby producing a seal therebetween along both the lower and upper portions of the sealing element.

7. The bath as claimed in claim 1, wherein the confronting surfaces are upwardly concave in a plane containing the opening.

8. The bath as claimed in claim 1, wherein the opening has a substantially flat lower portion and diverging side portions.

9. A bath particularly for use by an elderly or disabled person, the bath having a body with a side shaped so as to form an opening, a movable door arranged to close the opening and a sealing arrangement for sealing between the opening and the door, which comprises confronting surfaces between which sealing means is interposed and each of which is connected to one of the body and the door and are configured to be urged sealingly together by sliding of the door into the closed position, wherein substantially the entire door is situated below a water accommodating region of the body when fully opened and translation of the door substantially within its own plane effects closure of the opening and sealing between the confronting surfaces wherein the confronting surfaces are constituted by a first surface connected to the bath around the opening and,a second surface connected to an inwardly facing surface of the door, and one of the confronting surfaces is a skirt which is disengaged from the sealing means as a first step of opening the door.

10. A bath particularly for use by an elderly or disabled person, the bath having a body with a side shaped so as to form an opening, a movable door arranged to close the opening and a sealing arrangement for sealing between the opening and the door, which comprises confronting surfaces between which sealing means is interposed and each of which is connected to one of the body and the door and are configured to be urged sealingly together by sliding of the door into the closed position, wherein substantially the entire door is situated below a water accommodating region of the body when fully opened and translation of the door substantially within its own plane effects closure of the opening and sealing between the confronting surfaces wherein the confronting surfaces are constituted by a first surface connected to the bath around the opening and a second surface connected to an inwardly facing surface of the door, and upward movement of the door is arrested by sealing against the sealing means.

* * * * *